US008478141B2

(12) United States Patent
Naruse

(10) Patent No.: US 8,478,141 B2
(45) Date of Patent: Jul. 2, 2013

(54) IMAGE FORMATION APPARATUS

(75) Inventor: Akira Naruse, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 323 days.

(21) Appl. No.: 13/032,018

(22) Filed: Feb. 22, 2011

(65) Prior Publication Data

US 2011/0206389 A1 Aug. 25, 2011

(30) Foreign Application Priority Data

Feb. 24, 2010 (JP) ..... 2010-038212

(51) Int. Cl.
*G03G 15/08* (2006.01)

(52) U.S. Cl.
USPC ..... 399/27; 399/258; 399/106

(58) Field of Classification Search
USPC ..... 399/27, 258, 35, 106
See application file for complete search history.

(56) References Cited

U.S. PATENT DOCUMENTS 4,506,804 A 3/1985 Oka
4,592,642 A 6/1986 Imaizumi et al.
4,708,458 A 11/1987 Ueda et al.
5,436,704 A * 7/1995 Moon ..... 399/256

FOREIGN PATENT DOCUMENTS

JP 2001-100508 A 4/2001

OTHER PUBLICATIONS

Office Action issued by the U.S. Patent and Trademark Office in the U.S. Appl. No. 13/031,791, mailed Dec. 3, 2012, U.S. Patent and Trademark Office, Alexandria, VA. (16 pages).

* cited by examiner

*Primary Examiner* — Walter L Lindsay, Jr.
*Assistant Examiner* — Roy Y Yi
(74) *Attorney, Agent, or Firm* — Buchanan Ingersoll & Rooney PC

(57) ABSTRACT

An image formation apparatus including: a toner cartridge storing toner; a developer; a hopper temporarily storing toner supplied from the toner cartridge and supplying the developer with the toner; a magnetic sensor including a magnet and a reed switch that determines whether the magnet is within a detection area thereof, one of which is fixed to a predetermined position, and the other of which is configured to move downwards as a surface level of toner stored in a toner storage of the hopper decreases and thus serves as a surface level detector for detecting the surface level; a lifter configured to periodically lift the surface level detector above the surface level such that the magnet goes out of the detection area; and an ON-edge detector configured to detect ON-edges each indicating a point in time when the magnet has entered the detection area.

7 Claims, 13 Drawing Sheets

IMAGE FORMATION APPARATUS

CROSS-REFERENCE TO RELATED APPLICATIONS

This application is based on application No. 2010-038212 filed in Japan, the contents of which are hereby incorporated by reference.

BACKGROUND OF THE INVENTION (1) Field of the Invention

The present invention relates to image formation apparatuses, and in particularly to technology for preventing the amount of remaining toner in a hopper from being misdetected due to magnetic noise in the case of using a reed switch.

(2) Description of the Related Art

Electrophotographic image formation apparatuses form an image by first transferring a toner image, which has been obtained by developing an electrostatic latent image on a photosensitive drum by using a developer, onto a recording sheet, and then fixing the toner image by heat. The developer is supplied with toner from a detachable toner cartridge. Here, on the way of being conveyed to the developer, the toner is temporarily stored in the hopper.

FIG. 13 shows a mechanism for supplying the developer with toner from the toner cartridge, adopted in an image formation apparatus pertaining to prior art. As shown in FIG. 13, a toner cartridge 1301 has a cylindrical shape. The inner surface of the toner cartridge 1301 is provided with a protrusion that spirally extends along the surface. The toner cartridge 1301, which is detachable, is attached to a container holder 1302. When it is presumed that all the toner contained in the toner cartridge 1301 has been consumed, the toner cartridge 1301 is detached from the container holder 1302, and is replaced with a new one.

The toner cartridge 1301 has a toner outlet 1303. The end of the toner cartridge 1301 is connected with a drive shaft (not depicted). The toner cartridge 1301 is rotated by drive force from a motor 1304 via a gear wheel 1305. Due to the rotation, the spiral protrusion on the inner surface of the container conveys the toner. Thus, the toner is supplied to a hopper 1306 via the toner outlet 1303.

The hopper 1306 contains a stirring fin 1307 that is made from a thin elastic plate. The stirring fin 1307 is caused to slowly rotate along the inner surface of the hopper 1306, which prevents the toner from adhering to the inner surface, or being solidified.

A supplying screw 1308 is provided near the bottom of the hopper 1306. The supplying screw 1308 is rotated by drive force from the motor 1309. The supplying screw 1308 supplies the developer 1310 with an appropriate amount of toner, according to the amount of the toner stored in the developer 1310. The developer 1310 supplies toner onto the surface of a photosensitive drum 1311 in order to form a toner image.

To supply the hopper 1306 with an appropriate amount of toner from the toner cartridge 1301, it is necessary to measure the amount of the toner stored in the hopper timely.

In view of this necessity, various technologies have been developed. The technologies include: providing a piezoelectric sensor within the hopper and monitoring a signal that changes according to the amount of the toner contacting the surface of the sensor; using a photo interrupter to monitor whether the amount of remaining toner is greater than a given level; and using a reed switch to detect the position of a magnet attached to a detection plate placed on the surface of the toner. For example, see Japanese Patent Application Publication NO. 2001-100508.

In recent years, the demand for full-color, low-cost, and downsized image formation apparatuses has been increasing. In particular, a full-color image formation apparatus requires toners for many colors, and thus it is necessary to provide a hopper for each of the colors. This means that it is necessary to further downsize each of the hoppers, compared to black-and-white image formation apparatuses which require only one hopper.

In this regard, to minimize the cost, it is preferable to use a photo interrupter or a reed switch, because piezoelectric sensors mentioned above cost relatively expensive.

However, photo interrupters need a cleaner device to clean their light-transmissive windows, because dirt on the window deteriorates the detection accuracy. Such a cleaning device inherently needs to have durability at the same level as the image formation apparatus, which is a hindrance to the production of long-life and downsized image formation apparatuses with a low price.

The cases of using a reed switch also have a specific problem. A full-color image formation apparatus requires toners for many colors, and thus it is necessary to provide a hopper for each of the colors. This means that it is necessary to further downsize each of the hoppers, compared to black-and-white image formation apparatuses which require only one hopper, as described above.

Moreover, since the amount of toner consumption is different for each of the colors, the supplying screws in the hoppers need to be driven separately from each other. Thus, it is inevitable that the hoppers are provided close to each other, near the motor driving the supplying screws.

Therefore, the magnetic field generated by the motor might turn on or turn off the reed switches regardless of the amount of remaining toner in the hoppers. If this is the case, an unnecessary operation for supplying toner from the toner cartridges is performed even though a sufficient amount of toner is remaining in the hoppers.

The amount of the remaining toner in each toner cartridge is estimated based on the number of the toner supply operations that have been performed. That is, the amount of the remaining toner in the toner cartridge is estimated on the assumption that a certain amount of toner is actually supplied from the toner cartridge to the hopper every time the toner supply operation is performed.

Therefore, in the case where a sufficient amount of toner is remaining in the hopper and the toner supply operation does not actually supply the hopper with toner, the amount of the remaining toner in the toner cartridge will be estimated to have been decreased even though it has not been actually decreased.

If such estimation is repeated, the apparatus displays a message saying that the toner cartridge is empty, and unnecessarily encourages the user to replace the toner cartridge with a new one.

This problem could get worse if the downsizing of image formation apparatuses progresses further and the magnetic noise source gets closer to the reed switches.

SUMMARY OF THE INVENTION

One aspect of the present invention is an image formation apparatus comprising: a toner cartridge storing toner; a developer; a hopper temporarily storing toner supplied from the toner cartridge and supplying the developer with the toner; a magnetic sensor including a magnet and a reed switch that determines whether the magnet is within a detection area thereof, one of which is fixed to a predetermined position, and the other of which is configured to move downwards as a surface level of toner stored in a toner storage of the hopper decreases and thus serves as a surface level detector for detecting the surface level; a lifter configured to periodically lift the surface level detector above the surface level such that the magnet goes out of the detection area; an ON-edge detector configured to detect ON-edges each indicating a point in time when the magnet has entered the detection area; a misdetection determiner configured to determine an ON-edge as false when the lifter has not lifted the surface level detector after a point in time indicated by the previous ON-edge; and a toner supplier configured to supply the hopper with the toner from the toner cartridge under a condition that an ON-edge is not determined as false by the misdetection determiner.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIGS. 7A-7C are schematic diagrams showing relations between the rotations of the eccentric cam 305 and the swinging of the surface level detector 302, wherein FIG. 7A shows that the surface level detector 302 is lifted by the eccentric cam 305, and FIGS. 7B and 7C show that the surface level detector 302 floats on the surface of the toner, where the amount of the toner is large in FIG. 7B and small in FIG. 7C;

FIGS. 10A-10C show relations between the rotation time of the supplying screw 304 and the change of the state of the eccentric cam 305 during the rotation thereof, wherein FIG. 10A shows the rotation time of the supplying screw 304 and the change of the state of the eccentric cam 305 during the rotation thereof, FIG. 10B illustrates the change of the state of the eccentric cam 305 during the rotation thereof, with respect to the actual time, and FIG. 10C shows the change of the state of the supplying screw 304 during the rotation thereof, with respect to the actual time;

FIGS. 12A and 12B are timing charts illustrating operations of a reed switch 200 pertaining to Embodiment and the supplying screw 304, wherein FIG. 12A shows the case where there is no noise, and FIG. 12B shows the case where there is noise.

DESCRIPTION OF THE PREFERRED EMBODIMENTS

The following describes an embodiment of the image formation apparatus pertaining to the present invention, with reference to the drawings.

1. The Structure of the Image Formation Apparatus

First, the structure of the image formation apparatus pertaining to Embodiment is described.

Figure 1:
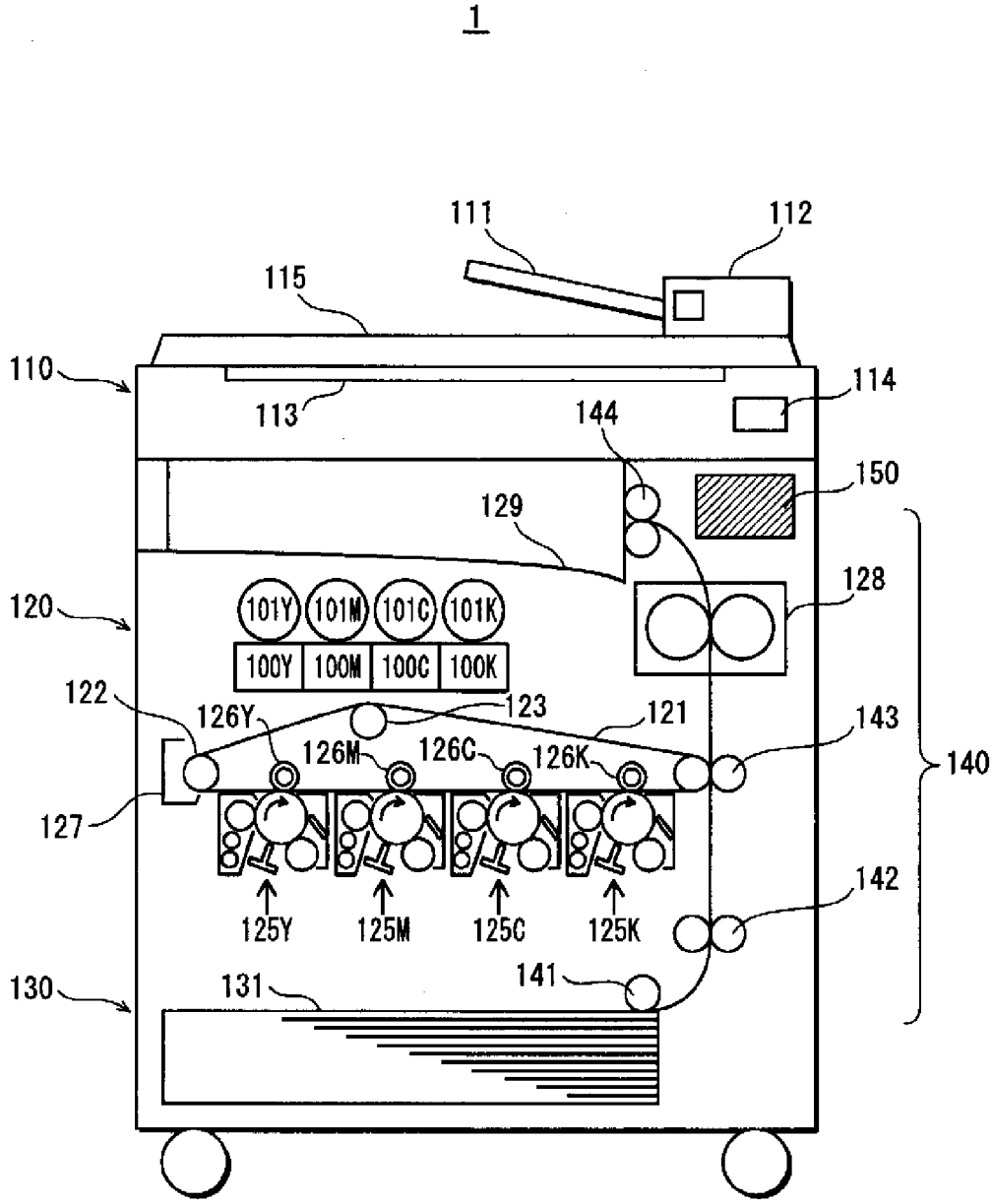
FIG. 1 shows primary components of the image formation apparatus pertaining to Embodiment of the present invention.

FIG. 1 shows primary components of the image formation apparatus pertaining to Embodiment of the present invention. As shown in FIG. 1, an image formation apparatus 1 is a tandem color image formation apparatus, which includes an image reader section 110, an image formation section 120, a paper storage section 130, a paper feeder section 140, and a controller 150.

The image reader section 110 includes a loading platform 111, a feeder 112, an original glass plate 113, a scanner 114, and a catch tray 115. According to directions from a user, the feeder 112 obtains an original placed on the loading platform 111 one sheet at a time, and conveys it onto the original glass plate 113. The original on the original glass plate 113 is read by the scanner 114, and ejected to the catch tray 115.

The scanner 114 includes a three-row CCD (Charge Coupled Device) line sensor corresponding to the three primary colors. The scanner 114 reads the original and generates image data in each color. Note that the scanner 114 may use a sheet-through method, in which the original is read by passing sheets through while the CCD line sensor is still.

Also, image data may be generated by exposing the original loaded on the original glass plate 113 with use of an exposure lamp and reflective mirrors that are moving in parallel with the original glass plate 113, and guiding the reflected light to the CCD line sensor via the plurality of reflective mirrors.

The image formation section 120 includes an intermediate transfer belt 121, rollers 122-124, image creators 125Y-125K, primary transfer rollers 126Y-126K, a cleaning device 127, a fixer 128, a catch tray 129 and a hopper 100.

The intermediate transfer belt 121 is suspended over the rollers 122-124. The image creators 125Y-125K are arranged in a row along the intermediate transfer belt 121 in the order of yellow (Y), magenta (M), cyan (C), and black (K). The image creators 125Y-125K each include a photosensitive drum, a charger, an exposure, a developer, and a cleaner.

The surface of the photosensitive drum is uniformly charged by the charger, and is then exposed by the exposure based on the image data generated by the scanner 114, so that an electrostatic latent image is formed. The electrostatic latent image is developed with toners in colors YMCK supplied from the developer. Thus a visible image (toner image) is formed.

The toner images created by the image creators 125Y-125K are electrostatically transferred by the primary transfer rollers 126Y-126K respectively at appropriate timings, so that the toner images are superimposed on the intermediate transfer belt 121. Accordingly, a color image is formed.

The paper storage section 130 includes a paper feed cassette 131. Recording sheets are stored in the paper feed cassette 131. Note that the paper storage section 130 may include a plurality of paper feed cassettes for recording sheets of different sizes, and may be configured to feed a recording sheet of a size specified by a user.

The paper feeder section 140 includes rollers 141-144. The roller 141 is a so-called pick-up roller, and obtains the recording sheets stored in the paper feed cassette 131 one at a time. The obtained recording sheets are then conveyed by the roller 142.

The roller 143 is a so-called secondary transfer roller and electrostatically transfers the toner image on the intermediate transfer belt 121 to the recording sheet. Thereafter, the residual toner on the intermediate transfer belt 121 is collected and disposed of by the cleaning device 127.

The fixer 128 includes a heating roller, a pressure roller and a heater lamp (not depicted). The fixer 128 melts the toner image on the recording sheet, and fuses the toner image to the recording sheet. The roller 144 is a so-called ejection roller, and ejects the recording sheet having the toner image fixed thereon onto the catch tray 129.

Note that the image formation apparatus 1 is provided with the toner cartridges 101Y-101K in colors YMCK attached thereto, and the toner cartridges 101Y-101K are detachable from the image formation apparatus 1. The toners in the toner cartridges 101Y-101K are supplied to the developers in the image creators 125Y-125K via the hoppers 100Y-100K, respectively.

The controller 150 performs general control of the operation of the image formation apparatus 1.

2. The Structures of the Hoppers 100Y-100K

Next, the structures of the hoppers 100Y-100K are described.

Figure 2:
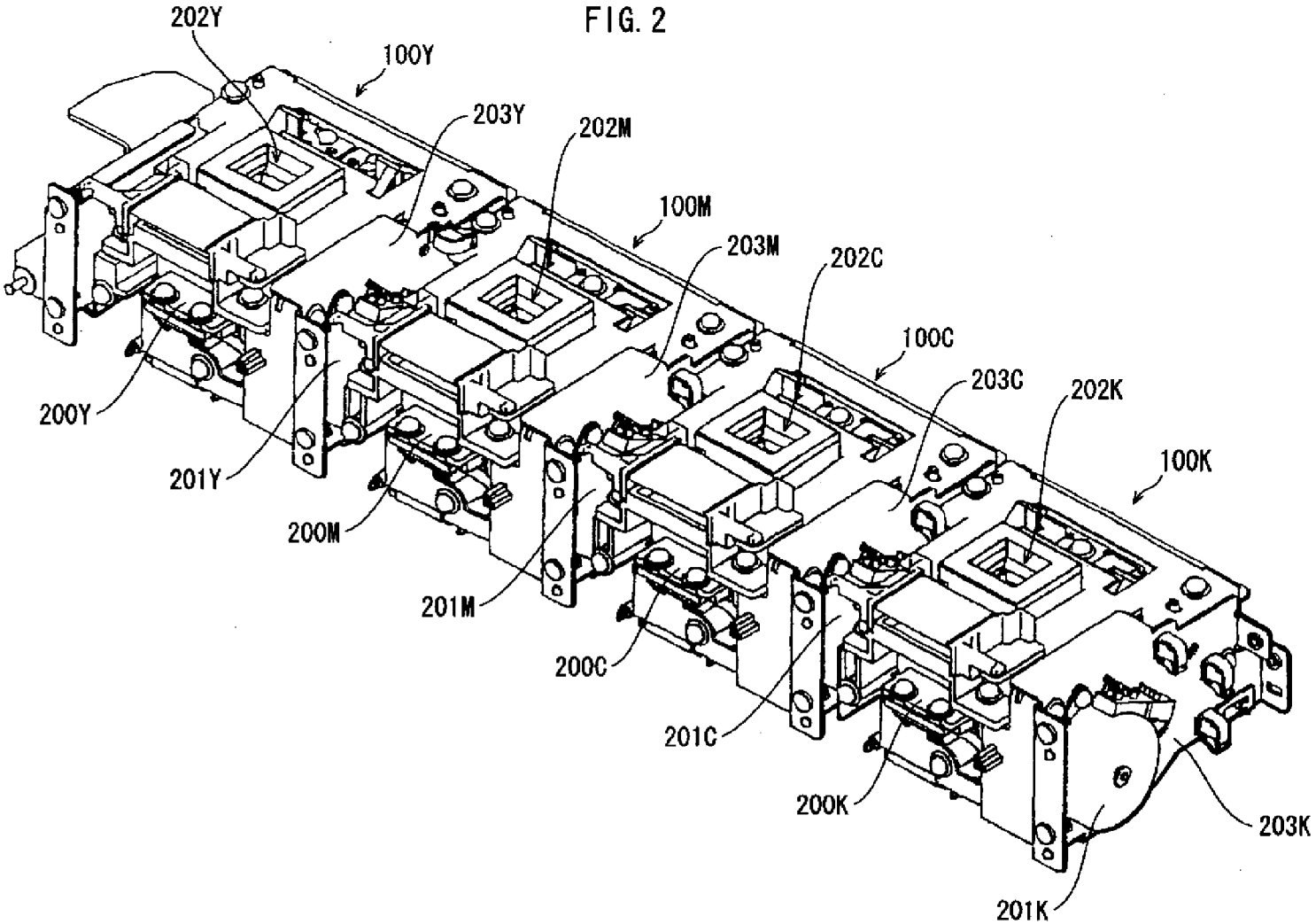
FIG. 2 is a perspective view showing primary components of the hoppers 100Y-100K pertaining to Embodiment of the present invention.

FIG. 2 is a perspective view showing primary components of the hoppers 100Y-100K. As shown in FIG. 2, the hoppers 100Y-100K are arranged in the order of Y, M, C and K adjacent to each other. The hoppers 100Y-100K are provided with reed switches 200Y-200K and supplying motors 201Y-201K, respectively.

The hoppers 100Y-100K are supplied with toner from the toner cartridges 101Y-101K via toner inlets 202Y-202K, which are provided on the tops of the hoppers 100Y-100K, respectively. The supplying motors 201Y-201K drive and rotate their respective supplying screws (not depicted), thereby supplying the developers of the image creators 125Y-125K with the toner contained in the hoppers 100Y-100K, respectively.

Here, in order to keep the toner density in the developers, the operations for supplying toner to the developers are performed in the following manner: the amount of toner to be supplied is determined based on information of the toner remaining in the developer; and the determined amount is converted into a rotation time of the supplying screw; and then the supplying screw is rotated for the rotation time.

The supplying motors 201Y-201K are attached to the main body of the hoppers 100Y-100K via metal plates 203Y-203K, respectively.

As described above, the supplying motors 201Y-201C are attached near the reed switches 200M-200K. Thus, the AC magnetic fields generated by the supplying motors 201Y-201C affect the reed switches 200M-200K. As a result, each of the reed switches 200M-200K would be repeatedly turned on and off.

Next, the internal structure of each hopper is described. Since the hoppers 100Y-100K have the same structure, the signs Y, M, C and K, each representing a toner color, are omitted in the following description. Even though, the description is applicable to any of the hoppers 100Y-100K.

Figure 3:
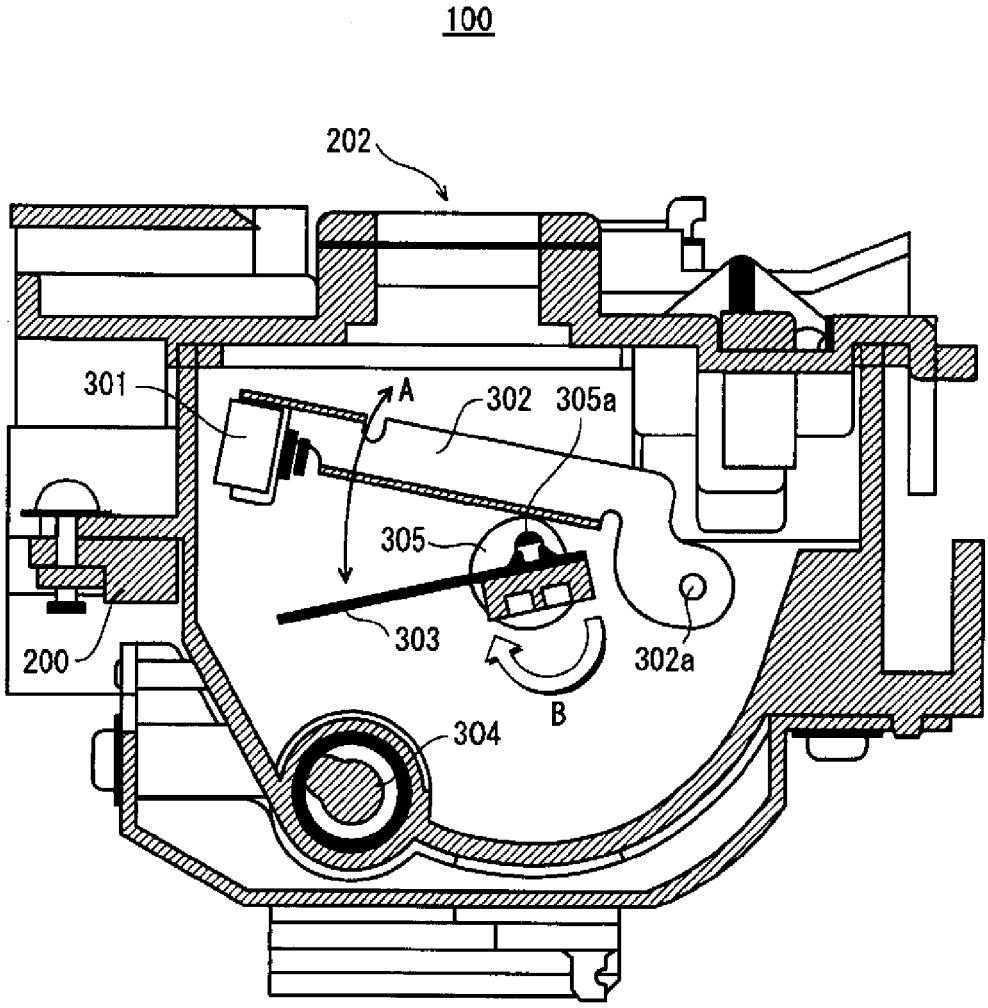
FIG. 3 is a cross-sectional view showing the structure of a hopper 100 pertaining to Embodiment of the present invention.
Figure 4:
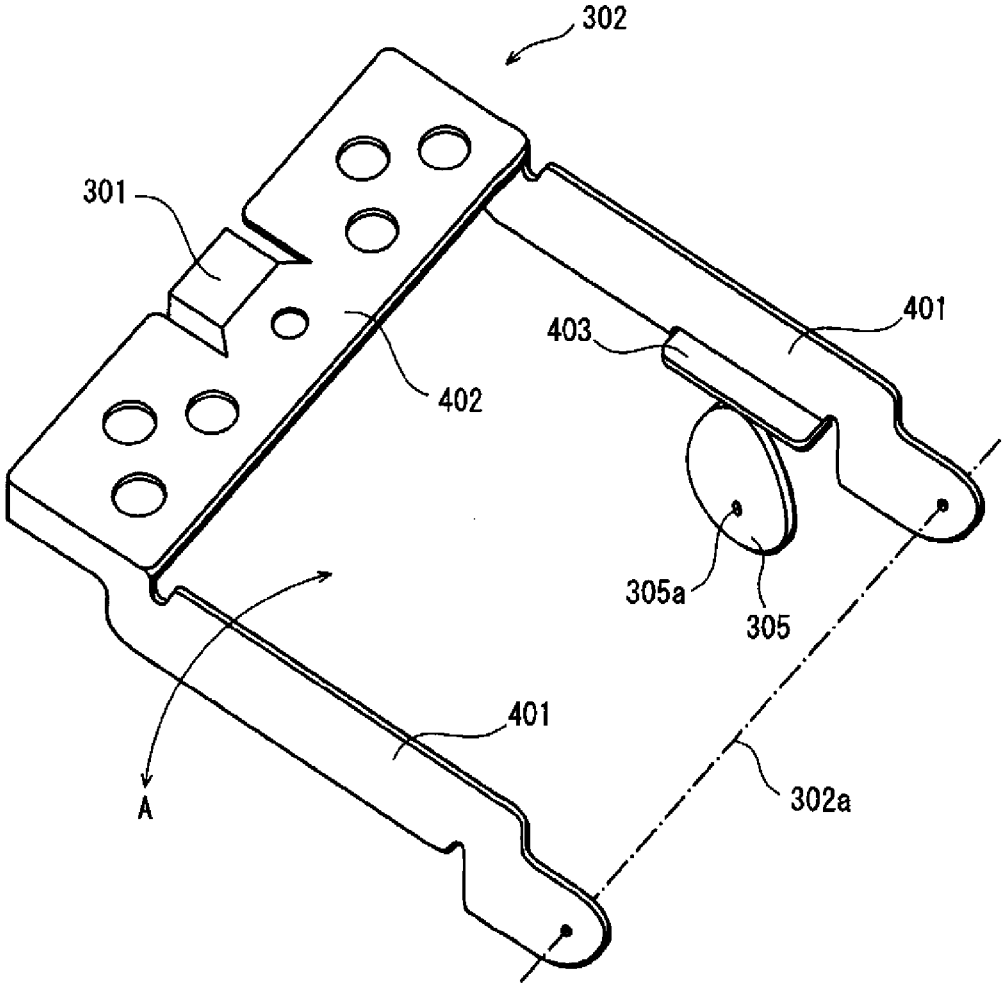
FIG. 4 is a perspective view showing the structure of a surface level detector 302 pertaining to Embodiment of the present invention.

FIG. 3 is a cross-sectional view showing the structure of a hopper 100. FIG. 4 is a perspective view showing the structure of the surface level detector 302. As shown in the drawings, the hopper 100 is provided with a magnet 301, a surface level detector 302, a stirring fin 303, a supplying screw 304, and an eccentric cam 305, in addition to the reed switch 200.

The surface level detector 302 has a swinging lever 401 whose one end is fixed and the other end that is unfixed can swing. A surface level detection plate 402 attached to the unfixed end of the swinging lever 401 is provided with the magnet 301 attached thereto. On the other side of the swinging lever 401, a turn back part 403 is provided. The turn back part 403 is placed on the eccentric cam 305.

Thus, as the eccentric cam 305 rotates toward the direction as represented by the arrow B, the surface level detector 302 swings in the direction represented by the two-headed arrow A. As a result, the magnet 301 is lifted above the toner surface once every time the eccentric cam 305 rotates once. Therefore, even if the magnet 301 is buried in the toner taken in from the toner inlet 202, the magnet 301 moves up above the surface.

After that, when the eccentric cam 305 rotates further, the surface level detection plate 302 stops at the surface level, and thus the magnet 301 is held at the surface level. The conduction status of the reed switch 200 changes according to the position where the magnet 301 is held, which leads to the detection of the running out of the toner.

The reed switch 200 pertaining to Embodiment is turned on when the magnet 301 gets close and is turned off when the magnet 301 gets away. However, the reed switch 200 may be turned off when the magnet 301 gets close and turned on when the magnet 301 gets away. The advantageous effect of the present invention can be achieved with such a structure.

Figure 5:
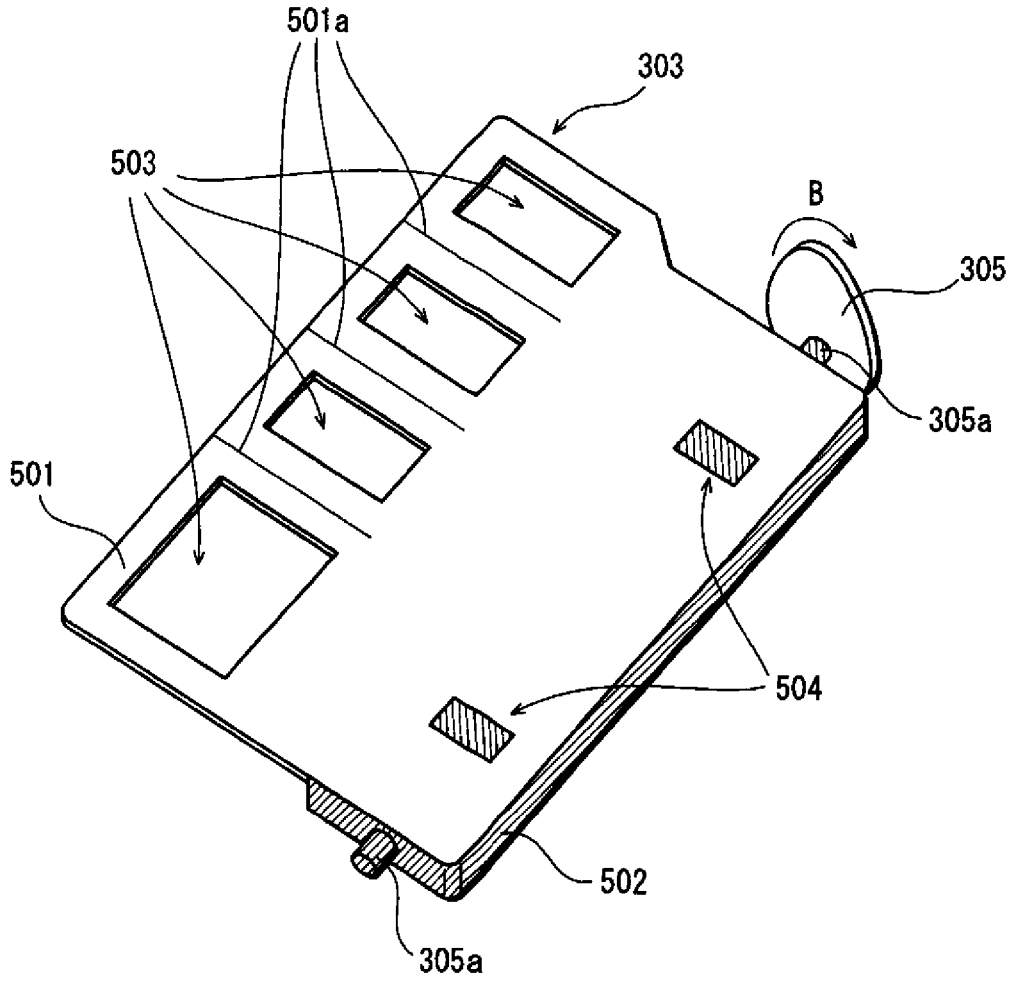
FIG. 5 is a perspective view showing the structure of a surface level detector 303 pertaining to Embodiment of the present invention.

The stirring fin 303 is attached to the eccentric cam 305, and swings together with the eccentric cam 305 so as to stir the toner contained in the hopper unit 100. FIG. 5 is a perspective view showing the structure of the stirring fin 303. As shown in FIG. 5, each stirring fin 303 consists of a film 501 made of resin and a supporter 502. The film 501 is provided with a through hole 504, which engages with a projection on the supporter 502.

The supporter 502 is attached to a rotation shaft 305*a* of the eccentric cam 305. The supporter 502 swings toward the direction represented by the arrow B as the eccentric cam 305 rotates. Accordingly, the film 501 also swings toward the direction represented by the arrow B. The film 501 is provided with a through hole 503. The toner stored in the hopper 100 passes trough the through hole 503 when the film 501 swings. Thus the toner is stirred.

The film 501 easily bends. Thus, even if the film 501 makes contact with the surface level detection plate 402 of the surface level detector 302 while swinging, it will not be interrupted by the surface level detection plate 402, and keep swinging. Also, slits 501*a* are provided between the through holes 503. Thus, each of the sections between the slits 501*a* individually bends when the film 501 swings.

Thus the toner stored in the hopper 100 is prevented from concentrating in one place. For example, if some toner is concentrated in one part on the way of the swinging of the film 501, the film 501 bends to a large degree in that place, and does not bend in other parts where the toner is not concentrated. Accordingly, the toner flows into a gap that occurs due to the difference between the degrees of the bending.

The supplying screw 304 rotates according to a control signal from the controller 150, and supplies the developer with a given amount of toner from the hopper 100. Here, if all toner around the supplying screw 304 has been supplied to the developer and thus a hollow occurs around the supplying screw 304, it will be impossible to supply the developer with toner no matter how many times the supplying screw 304 rotates.

However, the stirring fin 303 can eliminate such a hollow as it stirs the toner as described above, and certainly provides the developer with toner. For this reason or others, the supplying screw 304 is rotated by the supplying motor 201 and is connected to the stirring fin 303 and the surface level detector 302 via transmission gears and the eccentric cam 305 which are provided on an external wall of the hopper 100 that is opposite to the wall on which the supplying motor 201 is disposed.

Figure 6:
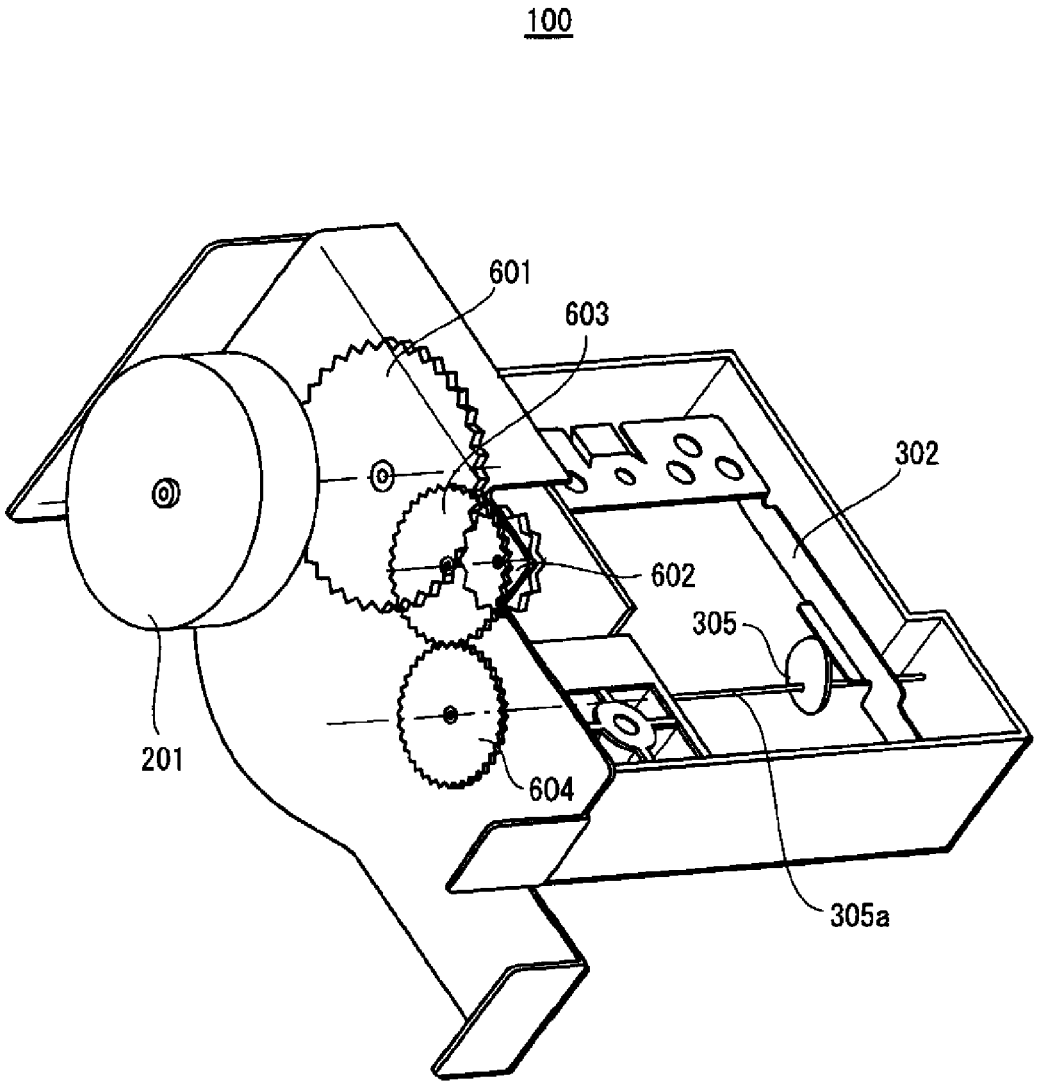
FIG. 6 is a cross-sectional view showing the transmission mechanism of the drive source for the hopper 100 pertaining to Embodiment of the present invention.

FIG. 6 is a cross-sectional view showing the transmission mechanism of the drive source for the hopper 100. As shown in FIG. 6, a transmission gear wheel 601 is fixed to the drive shaft via which the supplying motor 201 drives the supplying screw 304. The transmission gear wheel 601 meshes with the transmission gear wheel 602. The transmission gear wheel 602 rotates as the transmission gear wheel 601 rotates.

A transmission gear wheel 603 is fixed to the transmission gear wheel 602. The transmission gear wheel 603 has a different number of gear teeth and rotates as the transmission gear wheel 602 rotates, about the same rotation shaft. The transmission gear wheel 603 meshes with the transmission gear wheel 604. The transmission gear wheel 604 rotates as the transmission gear wheel 603 rotates. The eccentric cam 305 is fixed to the rotation shaft of the transmission gear wheel 604.

With such a structure, the supplying motor 201 and the eccentric cam 305 are connected to each other, and the rotation speed of the eccentric cam 305 is adjusted by the transmission gear wheels 601-604. Thus the supplying screw 304 and the surface level detector 302 operate in synchronization.

3. The Operations for Detecting the Amount of the Remaining Toner (1) The Operations of the Surface Level Detector 302

Figure 7A:
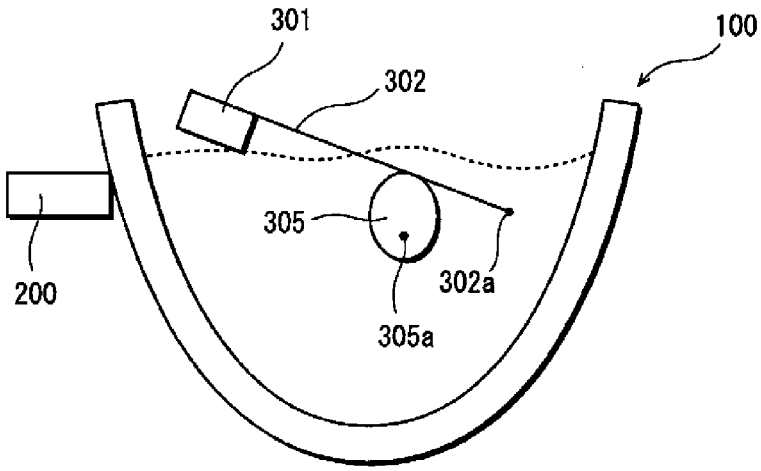
Figure 7B:
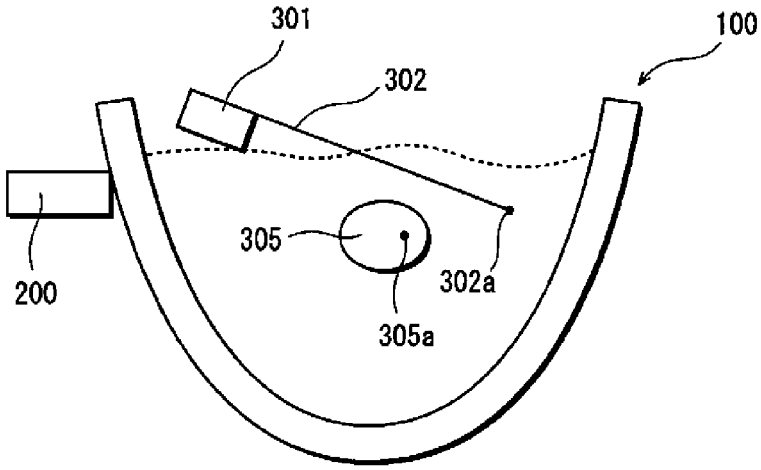
Figure 7C:
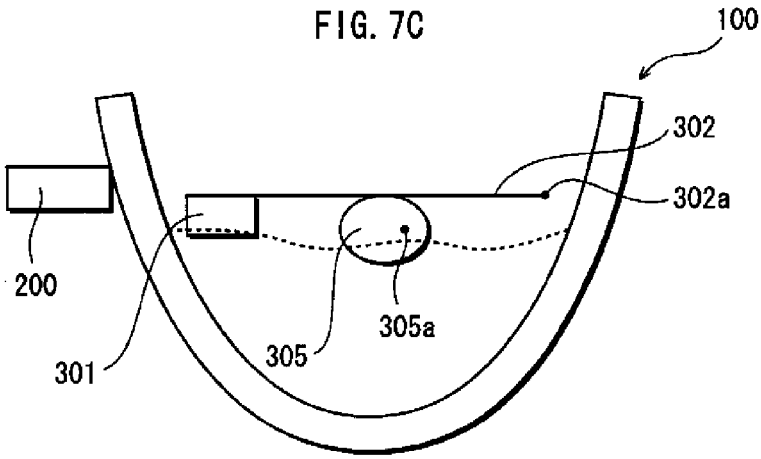

Next, the operations of the surface level detector 302 are described. FIGS. 7A-7C are schematic diagrams showing relations between the rotations of the eccentric cam 305 and the swinging of the surface level detector 302. FIG. 7A shows that the surface level detector 302 is lifted by the eccentric cam 305. FIGS. 7B and 7C show that the surface level detector 302 floats on the surface of the toner, where the amount of the toner is large in FIG. 7B and small in FIG. 7C.

As shown in FIG. 7A, when a sufficient amount of toner is stored in the hopper 100, the magnet 301 is held above the toner surface once the surface level detector 302 is lifted by the eccentric cam 305. Thus, the reed switch 200 is turned OFF.

In this case, the magnet 301 will be kept above the toner surface even when the eccentric cam 305 further rotates and the eccentric cam 305 and the surface level detector 302 move away from each other (FIG. 7B). Thus, the reed switch 200 is kept OFF.

After that, when the level of the toner surface in the hopper 100 lowers as the toner is supplied to the developer, the levels of the surface level detector 302 and the magnet 301 lower, accordingly. As a result, the magnet 301 gets close to the reed switch 200, and the state of the reed switch 200 changes from OFF to ON (FIG. 7C).

At the switching from OFF to ON (The time point when this switching occurs is hereinafter called "ON-edge"), the controller 150 determines that the amount of the remaining toner in the hopper 100 is not sufficient, and causes the toner supplying operation by which the hopper 100 is supplied with the toner from the toner cartridge 101. As a result, the level of the toner surface in the hopper 100 rises, whereas the surface level detection plate 402 of the surface level detector 302 is buried in the supplied toner.

After that, the eccentric cam 305 rotates and lifts the surface level detector 302. When the magnet 301 is held above the toner surface, the state of the reed switch 200 changes from ON to OFF.

(2) The Control System

The following describes the control system used for supplying the hopper 100 with the toner from the toner cartridge 101.

Figure 8:
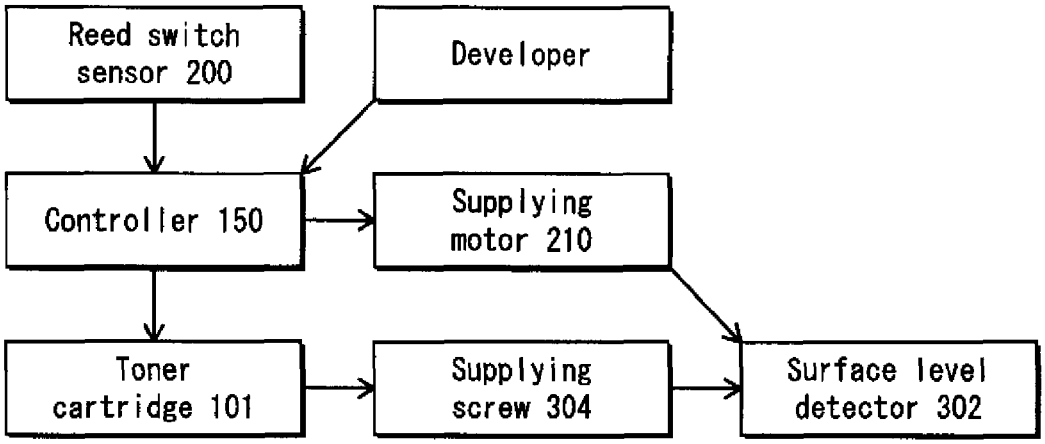
FIG. 8 is a block diagram showing the structure of the control system pertaining to Embodiment.

FIG. 8 is a block diagram showing the structure of the control system pertaining to Embodiment; As shown in FIG. 8, the controller 150 receives an ON-OFF binary signal indicating the amount of the remaining toner in the hopper 100 from the reed switch 200, and an ON-OFF binary signal indicating the amount of the remaining toner in the developer from the developer.

To supply the hopper 100 with toner, the controller 150 rotates the toner cartridge 101. The supplying motor 210 rotates the supplying screw 304 and the surface level detector 302 at the same time.

(3) Toner Supply Control

The following describes the control for supplying the hopper 100 with the toner from the toner cartridge 101. In the toner supply control, the controller 150 repeatedly checks the state of the reed switch 200, and determines whether it is necessary to supply the hopper 100 with toner.

Figure 9:
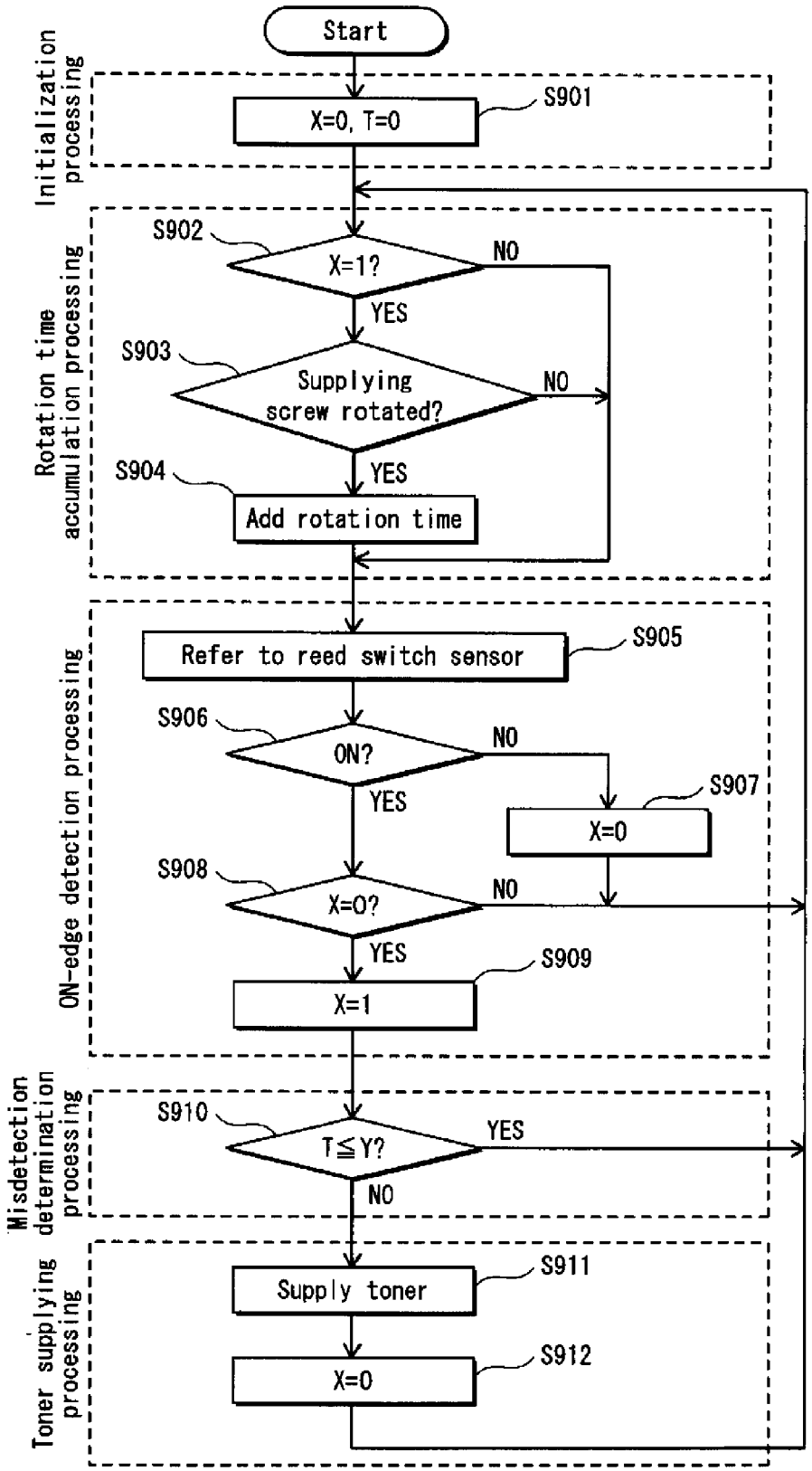
FIG. 9 is a flowchart showing procedures for toner supply control performed by a controller 150 pertaining to Embodiment.

FIG. 9 is a flowchart showing the procedures for the toner supply control performed by the controller 150. As shown in FIG. 9, the controller 150 first initializes a variable X and a variable T to 0 at the power-on (S901).

The variable X is used for detecting an ON-edge at which the state of the reed switch 200 changes from OFF to ON. X=0 means that the state of the reed switch 200 was OFF when the controller 150 previously referred to the state. X=1 means that the previous state of the reed switch 200 was ON. The variable T indicates the rotation time of the supplying screw 304 measured from the previous ON-edge.

Next, the controller 150 refers to the variable X. If X is 1 (S902: YES), the controller 150 determines whether the supplying screw 304 has been rotated. If determined that the supplying screw 304 has been rotated (S903: YES), the controller 150 adds its rotation time to the variable T (S904).

If the variable X is not 1, (S902: NO), or if the supplying screw 304 has not been rotated (S903: NO), or after Step S904 is performed, the controller 150 refers to the state of the reed switch 200 (S905). If the reed switch 200 is in the OFF state (S906: NO), the controller 150 substitutes 0 into the variable X (S907). If the reed switch 200 is in the ON state (S906: YES), the controller 150 refers to the variable X.

If the variable X is 1 (S908: NO), that is, if the previous state of the reed switch 200 is ON, it is determined that the ON state is continuing and is not occurred due to an ON-edge. Thus, the controller 150 does not perform the toner supply control.

If the variable X is 0 (S908: YES), it is determined that the previous state was OFF and the current state is ON. Thus, the controller 150 determines that it has detected the ON-edge. Thus, the controller 150 substitutes 1 into the variable X (S909), and refers to the variable T.

As with conventional technologies, the controller 150 manages the rotation time of the supplying screw in order to properly control the amount of the toner to be supplied to the developer. In this embodiment, both the supplying screw 304 and the eccentric cam 305 are driven by the supplying motor 201. Thus, the time required for the eccentric cam 305 to rotate once can be converted to the rotation time of the supplying screw 304.

Therefore, it is possible to specify the state (i.e. posture) of the eccentric cam 305 at a given time point in the rotation by referring to the rotation time of the supplying screw 304. Thus, it is possible to specify the state of the surface level detector 302 at the time point in the swinging.

Figure 10A:
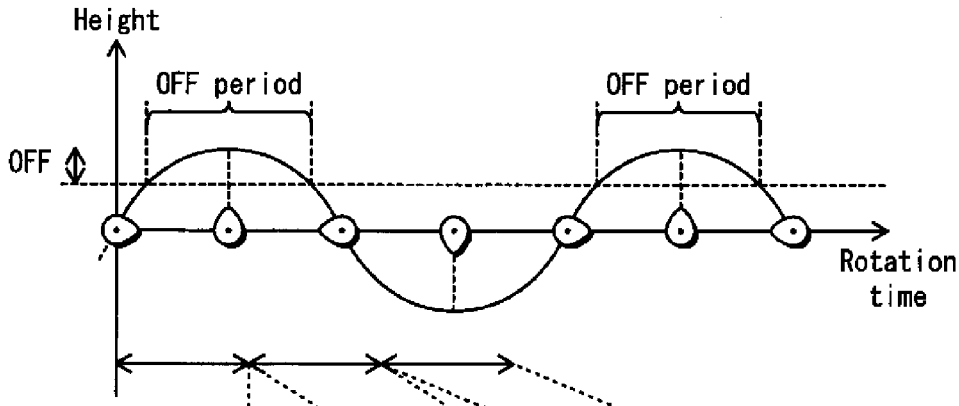
Figure 10B:
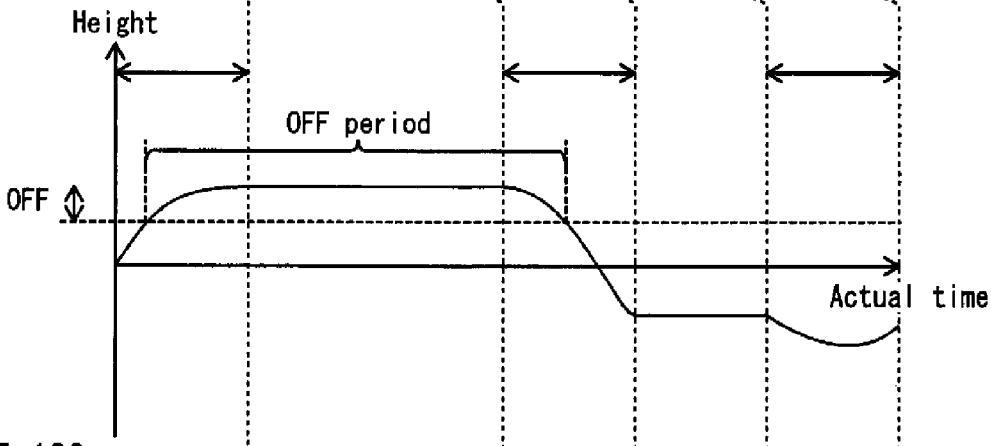
Figure 10C:
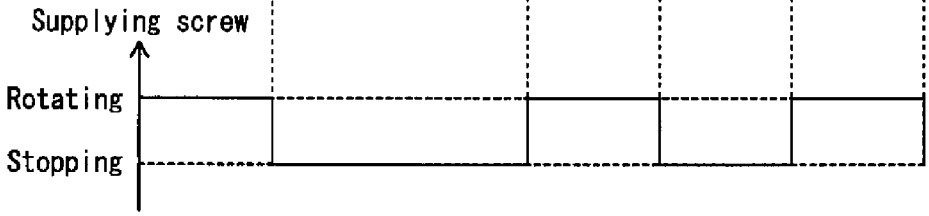

FIGS. 10A-10C show relations between the rotation time of the supplying screw 304 and the change of the state of the eccentric cam 305 during the rotation thereof. FIG. 10A shows the rotation time of the supplying screw 304 and the change of the state of the eccentric cam 305 during the rotation thereof. FIG. 10B illustrates the change of the state of the eccentric cam 305 during the rotation thereof, with respect to the actual time. FIG. 10C shows the change of the state of the supplying screw 304 during the rotation thereof, with respect to the actual time.

In each of FIGS. 10A and 10B, the vertical axis indicates the relative height of the point on the external surface of the eccentric cam 305 that is furthest from the rotation shaft (The point is hereinafter called "the furthest point"). The horizontal axis in FIG. 10A indicates the rotation time of the supplying screw 304. The horizontal axes in FIGS. 10B and 10C each indicate the actual time. The vertical axis in FIG. 10C shows the operation state of the supplying screw 304, that is, whether the supplying screw 304 is rotating or stopping.

As shown in FIG. 10A, the eccentric cam 305 rotates as the supplying screw 304 rotates, and thus the height of the furthest point changes along a sine curve as the rotation time of the supplying screw 304 increases. The period that includes a time point at which the furthest point reaches its highest point is an OFF period shown in the drawings. In each of the OFF periods, the magnet 301 is lifted up to its highest level so that it is moved away from the reed switch 200. Thus, in the OFF periods, the reed switch 200 is kept in the OFF state, certainly.

On the other hand, as shown in FIG. 10C, the supplying screw 304 supplies the developer with toner in response to requests from the developer. In the OFF periods, the supplying screw 304 does not supply the developer with toner. In these periods, the eccentric cam 305 does not rotate, either. Thus, as shown in FIG. 10B for example, the eccentric cam 305 rotates only while the supplying screw 304 is rotating, and when the supplying screw 304 stops, the eccentric cam 305 stops in the state at the time.

As described above, the eccentric cam 305 rotates as the supplying screw 304 rotates. Thus, it is possible to determine whether the eccentric cam 305 is in any of the OFF periods or not, based on the rotation time of the supplying screw 304. Here, even outside the OFF periods, the reed switch 200 is in the OFF state while a sufficient amount of toner is being stored in the hopper 100 and the magnet 301 is floating above the toner surface.

Figure 11:
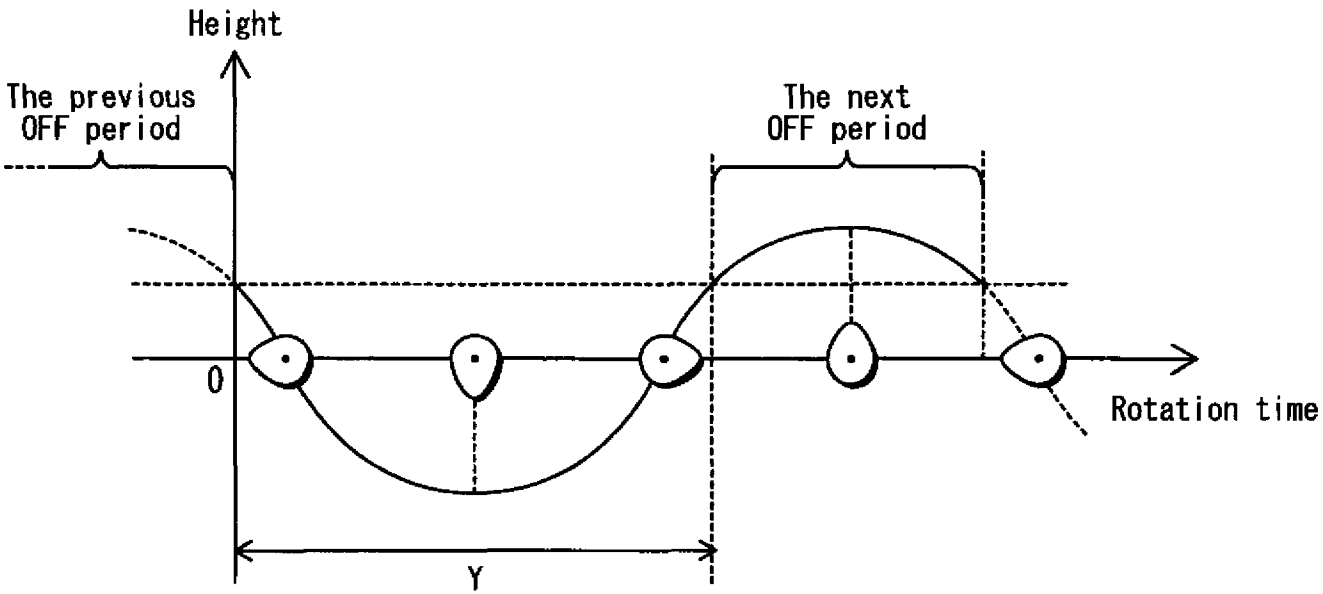
FIG. 11 shows the rotation time of the supplying screw 304 and the change of the state of the eccentric cam 305 during the rotation thereof, pertaining to Embodiment.

In this embodiment, the variable T is initialized to 0 at the end of each OFF period (i.e. the ON-edge) of the eccentric cam 305, and every time the supplying screw 304 rotates, its rotation time is added to the variable T. If an ON-edge is detected before the next OFF period begins (i.e., when the variable T is no greater than Y), the controller 150 determines it as a detection error (FIG. 11).

In FIG. 9 again, if the variable T is no greater than Y, that is, if the next OFF period has not begun (S910: YES), the controller 150 determines that the reed switch 200 has come into the ON state due to noise, and does not perform the toner supply control. Otherwise (S910: NO), the controller 150 supplies the hopper 100 with the toner from the toner cartridge 101 (S911), and initializes the variable T to 0 (S912).

After completing Step S907 or Step S912, or when determined in the negative in Step S908, or when determined in the affirmative in Step S910, the controller 150 moves to Step S902, and repeats the procedures described above.

Figure 12A:
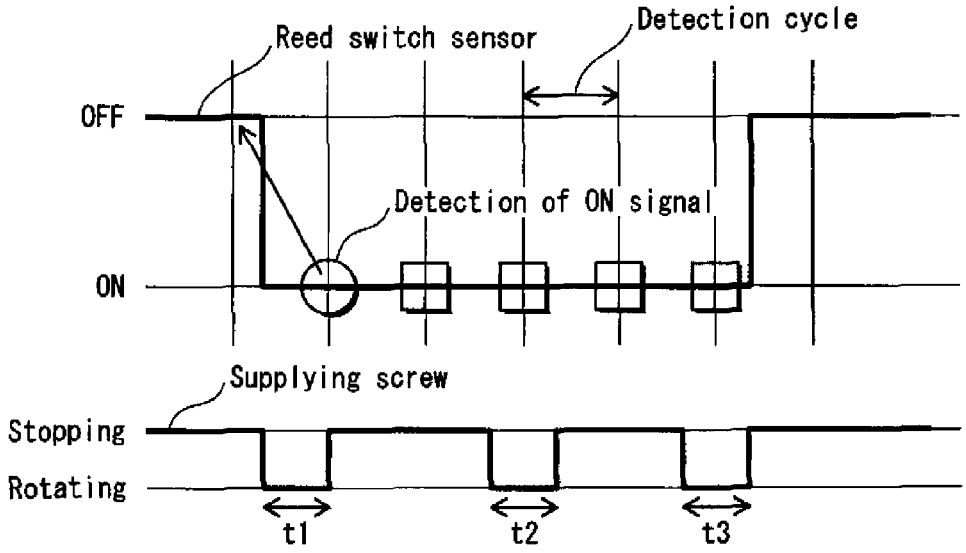
Figure 12B:
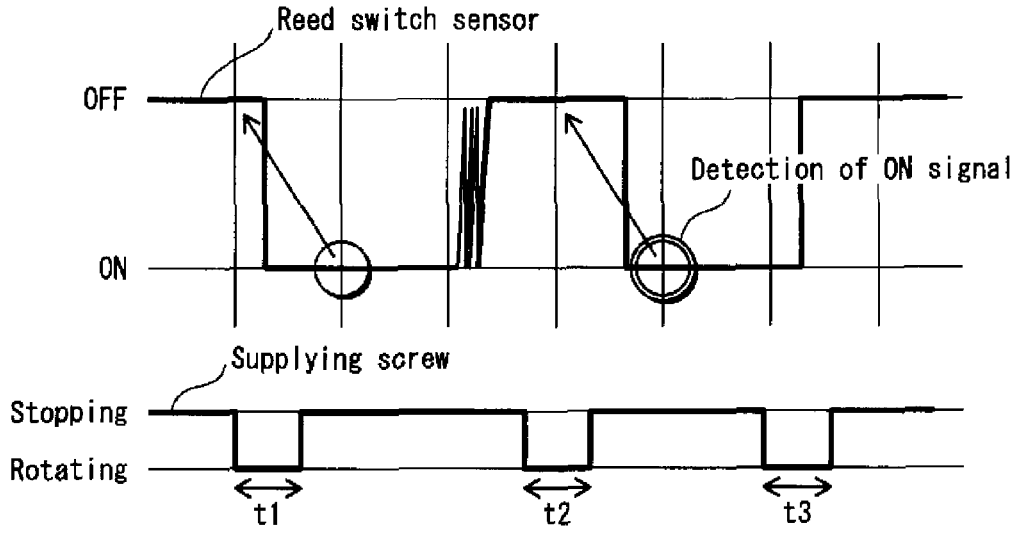
Figure 13:
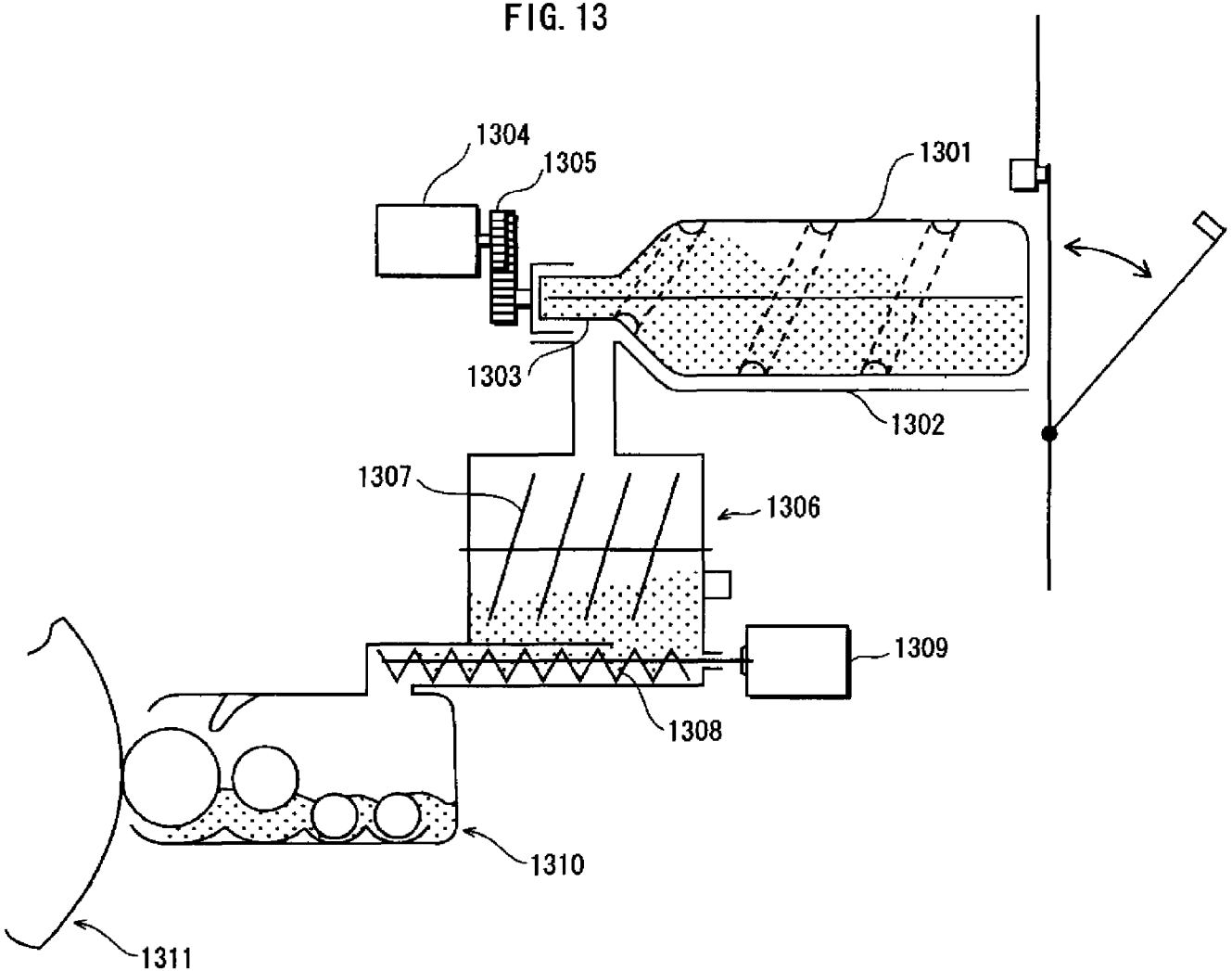
FIG. 13 shows a mechanism for supplying the developer with toner from the toner cartridge, adopted in an image formation apparatus pertaining to prior art.

FIGS. 12A and 12B are timing charts illustrating the operations of the reed switch 200 and the supplying screw 304. FIG. 12A shows the case where there is no noise, and FIG. 12B shows the case where there is noise.

As shown in FIG. 12A, in the case where there is no noise, the controller 150 repeatedly refers to the state of the reed switch 200 and supplies the hopper 100 with the toner from the toner cartridge 101 when detecting an ON-edge at which the state changes from the OFF state to the ON state (as depicted as a circle in the drawing). Then, after the ON state continues (as depicted as squares in the drawing), and when the magnet 301 is lifted above the toner surface by the rotation of the eccentric cam 305, the reed switch 200 comes into the OFF state.

On the other hand, in the case where there is noise as shown in FIG. 12B, the reed switch 200 comes into the OFF state due to the noise at the point it should not, and the controller 150 detects a false ON-edge (as depicted as a double circle in the drawing).

An ON-edge is not always detected at the same time as the reed switch 200 goes out of an OFF period. Thus, for example, when an ON-edge is detected a certain period after the reed switch 200 goes out of an OFF period, there is a possibility that the reed switch 200 comes into the OFF state within the time Y.

However, there is no possibility that immediately after the reed switch 200 comes into the OFF state once, the toner contained in the hopper 100 runs out and the reed switch 200 comes into the ON state again. In other words, there is no possibility that two or more ON-edges are detected within the time Y after the reed switch 200 once goes out of the OFF period and thus an ON-edge is detected.

In view of this observation, the present embodiment determines whether an ON-edge is true or false by comparing the reference time Y described above with the time T to which the rotation times t1, t2, t3 . . . of the supplying screw 304 have been added (i.e., T=t1+t2+t3+ . . . ). If the ON-edge is a false ON-edge, the controller 150 prohibits the toner supplying operations.

Therefore, the controller 150 is capable of prohibiting unnecessary operations for supplying toner. Thus, it is possible to prevent misdetection of insufficient remaining toner within the toner cartridge 101 when actually a sufficient amount of toner is remaining.

As described above, in the cases where two consecutive ON-edges are correctly detected, the magnet should be biased by a biasing unit and go out of the detection area of the magnetic sensor in the period between the ON-edges. However, if such a biasing is not performed in the period, the detection of the latter one of the two ON-edges must be a misdetection. The present invention detects such a misdetection, and prevents operations for supplying toner from being unnecessarily performed.

4. Modifications

The present invention is described above based on Embodiment. However, the present invention is not limited to Embodiment, as a matter of course. The following modifications are applicable.

(1) In Embodiment described above, the magnet 301 is lifted up to the toner surface by using the eccentric cam 305. However, it is not essential that the present invention has such a structure. Any other means may be used for lifting up the magnet 301. For example, the advantageous effect of the present invention can be achieved by using a crank mechanism for lifting up the magnet 301 above the toner surface.

(2) In Embodiment described above, both the supplying screw 304 and the eccentric cam 305 are rotated by the supplying motor 201. However, it is not essential that the present invention has such a structure. The advantageous effects of the present invention can be achieved even when the supplying screw 304 and the eccentric cam 305 are separately rotated by individual drive sources. Note, however, that using a single drive source in common reduces the size of the apparatus.

(3) In Embodiment described above, the state of the eccentric cam 305 during the rotation thereof is specified based on the rotation time of the supplying screw 304. However, the present invention is not limited to this. Any other means may be used for specifying the state of the eccentric cam 305.

For example, the advantageous effects of the present invention can be achieved by using a sensor to detect the state of the eccentric cam 305 during the rotation thereof. Note, however, that the rotation times of the supplying screw 304 and the supplying motor 201 is conventionally put under control in order to control the amount of toner to be supplied to the developer. Thus, if the rotation time is used, it is easy to specify the state of the eccentric cam 305 during the rotation thereof.

(4) Although not particularly mentioned in the description of Embodiment, the present invention is applicable to any kind of electrophotographic image formation apparatuses in which toner cartridges are used for supplying toner, including recording apparatuses and display apparatus, such as copiers, facsimile machines and printers, no matter color or black and white apparatuses they are.

(5) In Embodiment described above, the reed switch 200 is fixed and the magnet 301 is configured to swing. However, it is not essential that the present invention has such a structure. The advantageous effects of the present invention can be achieved even when the magnet is fixed and the reed switch is placed above the toner surface.

(6) In Embodiment described above, the magnet 301 is attached to the surface level detection plate 402. However, it is not essential that the present invention has such a structure. Instead of the surface level detection plate, a flat-plate shaped magnet may be attached to the swinging arm. Even when a flat-plate shaped magnet is used, the toner surface can be detected in the same manner as the surface level detection plate.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image formation apparatus comprising:

a toner cartridge storing toner;

a developer;

a hopper temporarily storing toner supplied from the toner cartridge and supplying the developer with the toner;

a magnetic sensor including a magnet and a reed switch that determines whether the magnet is within a detection area thereof, one of which is fixed to a predetermined position, and the other of which is configured to move downwards as a surface level of toner stored in a toner storage of the hopper decreases and thus serves as a surface level detector for detecting the surface level;

a lifter configured to periodically lift the surface level detector above the surface level such that the magnet goes out of the detection area;

an ON-edge detector configured to detect ON-edges each indicating a point in time when the magnet has entered the detection area;

a misdetection determiner configured to determine an ON-edge as false when the lifter has not lifted the surface level detector after a point in time indicated by the previous ON-edge; and a toner supplier configured to supply the hopper with the toner from the toner cartridge under a condition that an ON-edge is not determined as false by the misdetection determiner.

2. The image formation apparatus of claim 1, wherein the lifter includes:

an eccentric cam; and a swinging lever having an unfixed end and placed on the eccentric cam so as to swing as the eccentric cam rotates, and the surface level detector is attached to the unfixed end.

3. The image formation apparatus of claim 2, wherein the misdetection determiner makes the determination based on a rotation angle of the eccentric cam.

4. The image formation apparatus of claim 3 further comprising:

a supplying screw configured to supply the developer with the toner stored in the hopper; and a drive source configured to drive the supplying screw, wherein the eccentric cam is rotated by the drive source in synchronization with the supplying screw.

5. The image formation apparatus of claim 4, wherein the misdetection determiner obtains the rotation angle of the eccentric cam based on a rotation time of the supplying screw.

6. The image formation apparatus of claim 2, wherein the swinging lever has a detection plate attached to the unfixed end thereof, and the surface level detector is attached to the detection plate.

7. The image formation apparatus of claim 1, wherein the surface level detector has a plate-like shape.

* * * * *